US009982398B2

(12) United States Patent
Narsingh et al.

(10) Patent No.: US 9,982,398 B2
(45) Date of Patent: May 29, 2018

(54) HOPPER INSERT FOR AN ASPHALT PAVING MACHINE

(71) Applicant: Wirtgen America, Inc., Antioch, TN (US)

(72) Inventors: Laikram Narsingh, Chambersburg, PA (US); James E. Meridieth, South Gallatin, TN (US); Jay Scott Johnson, Orlando, FL (US)

(73) Assignee: Wirtgen America, Inc., Antioch, TN (US)

( * ) Notice: Subject to any disclaimer, the term of this patent is extended or adjusted under 35 U.S.C. 154(b) by 0 days. days.

(21) Appl. No.: 15/618,876

(22) Filed: Jun. 9, 2017

(65) Prior Publication Data

US 2017/0275830 A1 Sep. 28, 2017

Related U.S. Application Data

(62) Division of application No. 14/746,558, filed on Jun. 22, 2015, now Pat. No. 9,702,095.

(51) Int. Cl.
*E01C 19/02* (2006.01)

(52) U.S. Cl.
CPC ..... *E01C 19/02* (2013.01)

(58) Field of Classification Search
CPC ..... E01C 19/02; E01C 19/48; E01C 19/002; E01C 19/45; E01C 19/18; E01C 18/18; E01C 2301/00
See application file for complete search history.

(56) References Cited

U.S. PATENT DOCUMENTS 3,394,094 A * 7/1968 Kayser ..... C08L 95/00 524/71
3,411,757 A * 11/1968 Hale ..... B28C 5/1292 366/250
3,484,083 A * 12/1969 Albertini ..... B65G 27/00 366/22
3,967,912 A 7/1976 Parker
3,997,277 A 12/1976 Swisher, Jr. et al.
4,304,504 A 12/1981 Trujillo
4,507,015 A * 3/1985 Furukawa ..... E01C 13/065 404/101
4,676,690 A 6/1987 Allen
4,865,259 A * 9/1989 Collette ..... E01C 19/1004 241/186.5
4,934,864 A 6/1990 Mauldin
(Continued)

FOREIGN PATENT DOCUMENTS

DE 202013103134 U1 * 10/2014 ..... E01C 19/15

OTHER PUBLICATIONS

Ex. A: Photographs and annotated dimensions of a Roadtec hopper insert (2 pp.) (undated but admitted to be prior art).

(Continued)

*Primary Examiner* — Abigail A Risic
(74) *Attorney, Agent, or Firm* — Lucian Wayne Beavers; Patterson Intellectual Property Law, PC

(57) ABSTRACT

A hopper insert for an asphalt paving machine. The hopper insert provides for passive mixing of asphalt material, and also provides a dual capacity loading option. Two upper baffles extend across an open upper end of the hopper insert. A grate extends between the upper baffles. Asphalt material is received on top of the grate between the upper baffles.

6 Claims, 11 Drawing Sheets

(56) References Cited

U.S. PATENT DOCUMENTS

| | | | | |
|---|---|---|---|---|
| 4,964,752 | A | 10/1990 | Astrope et al. | |
| 5,000,615 | A * | 3/1991 | Murray | E01C 23/065 404/101 |
| 5,215,372 | A * | 6/1993 | Milstead | E01C 19/10 209/373 |
| 5,362,193 | A * | 11/1994 | Milstead | B65D 88/30 414/332 |
| 5,401,115 | A | 3/1995 | Musil et al. | |
| 5,484,229 | A | 1/1996 | Reece | |
| 5,641,249 | A | 6/1997 | McClelland | |
| 5,722,790 | A | 3/1998 | Spray | |
| 6,007,272 | A * | 12/1999 | Macku | E01C 19/1077 366/319 |
| 6,071,040 | A * | 6/2000 | Macku | E01C 19/48 404/108 |
| 6,193,437 | B1 | 2/2001 | Heims | |
| 7,785,034 | B2 | 8/2010 | Hood et al. | |
| 7,992,704 | B2 | 8/2011 | Weiler | |
| 8,092,117 | B2 | 1/2012 | Hill et al. | |
| 8,545,128 | B2 | 10/2013 | Weiler | |
| 2003/0035688 | A1 | 2/2003 | Vance et al. | |
| 2009/0285631 | A1 | 11/2009 | Buschmann et al. | |
| 2010/0150652 | A1 | 6/2010 | Johnson et al. | |
| 2011/0002736 | A1 | 1/2011 | Monger et al. | |
| 2013/0010565 | A1 | 1/2013 | Campbell et al. | |
| 2016/0108585 | A1 | 4/2016 | Blank | |
| 2016/0145814 | A1 * | 5/2016 | Dwegerser | E01C 19/15 404/110 |
| 2016/0194838 | A1 | 7/2016 | Amstutz et al. | |

OTHER PUBLICATIONS

Ex. B: Photographs of a Weiler hopper insert and bolt on upper extension (1 p.) (undated but admitted to be prior art).

Ex. C: Vögele Brochure "MT 3000-2i" (17 sheets) (undated but admitted to be prior art).

* cited by examiner

HOPPER INSERT FOR AN ASPHALT PAVING MACHINE

BACKGROUND OF THE INVENTION

1. Field of the Invention

The invention relates to hopper inserts for use with asphalt paving machines, and particularly to hopper inserts designed to promote passive remixing of asphalt material and to minimize thermal and mechanical segregation of the asphalt material while retaining adequate surge capacity.

2. Description of the Prior Art

Asphalt paving machines typically have an integral receiving hopper on the front end of the machine which receives asphalt material which is to be spread on the ground by the paving machine. The typical integral receiving hopper of an asphalt paving machine has a relatively low front wall to allow asphalt material to be dumped from a dump truck directly into the hopper.

Additionally, it is known to provide hopper inserts which are placed in the integral receiving hopper of the asphalt paving machine, which hopper inserts increase the volume of asphalt material which can be carried by the asphalt paving machine.

When using a material transfer vehicle (MTV) which is located intermediate between the dump truck and the paving machine, it is common to use a hopper insert, which will have substantially higher walls and capacity than does the integral hopper of the paving machine. The material transfer vehicle (MTV) receives the asphalt material from the dump truck, and then conveys the asphalt material up an elevated conveyor to drop it into the top of the hopper insert located on the paving machine.

One issue which is always important to a successful asphalt paving job is to avoid segregation of the aggregate material in the asphalt mix and to avoid thermal segregation, namely the formation of cool spots, in the asphalt mix. There is a continuing need for improvements in asphalt handling equipment to prevent or minimize both aggregate segregation and thermal segregation within the asphalt mix.

SUMMARY OF THE INVENTION

In one embodiment a hopper insert apparatus is provided for an asphalt paving machine. The apparatus includes a perimeter wall defining a hopper insert interior, the interior having an open upper end for receiving incoming asphalt material, and an open lower end for discharging the asphalt material. An upper end cross-sectional area of the open upper end is greater than a lower end cross-sectional area of the open lower end. First and second upper baffles extend across the hopper insert interior and are supported from the perimeter wall. The upper baffles are located closer to the upper end than to the lower end. The upper baffles are spaced laterally apart from each other. A grate is supported within the interior. The upper baffles extend upwardly higher than the grate for retaining asphalt material on the grate.

In another embodiment a hopper insert apparatus is provided for an asphalt paving machine. The apparatus includes a perimeter wall defining a hopper insert interior, the interior having a larger open upper end for receiving incoming asphalt material and a smaller open lower end for discharging the asphalt material. A grate is located closer to the open upper end than to the open lower end. The grate is laterally spaced from the perimeter wall around at least a majority of the periphery of the perimeter wall.

In another embodiment a method is provided for passive mixing of asphalt material with a hopper insert for an asphalt paving machine. The hopper insert includes a larger upper open end and a smaller lower open end so that the hopper insert is funnel shaped. The method may include the steps of:

(a) receiving the asphalt material on top of a grate located nearer to the upper end than to the lower end of the hopper insert;

(b) reducing an average clump size of the asphalt material as at least a portion of the asphalt material passes through the grate; and (c) discharging the asphalt material out the smaller lower open end of the hopper insert onto a conveyor of the asphalt paving machine.

The grate may include a plurality of parallel grate bars spaced apart from each other by a spacing in a range of from about 3 inches to about 8 inches.

The grate bars may extend transversely between the first and second upper baffles.

The grate may define an upper grate surface located at least 6 inches, more preferably at least 12 inches, and most preferably at least about 18 inches, lower than an uppermost extent of the central portions of the upper baffles so that asphalt material may be piled upon the grate to a depth of at least 6 inches, more preferably at least 12 inches, and most preferably at least 18 inches.

The grate may be superimposed over a majority of, or over the entire lower end of the hopper insert apparatus.

The grate may be spaced from the perimeter wall so that at least one grate bypass is defined between the grate, the perimeter wall and the upper baffles.

The central portion of each of the upper baffles may have a lower edge located lower than the open upper end.

The first and second upper baffles may flare downwardly away from each other.

The lateral spacing between the first and second upper baffles may vary along the length of the upper baffles.

The perimeter wall may include a front wall portion and a rear wall portion, and the upper baffles may have front and rear ends supported from the front and rear wall portions, respectively.

The perimeter wall may include four major walls joined together at their lower ends to define a four sided opening having four lower corners. The four major walls may slope away from each other along at least a part of a wall height from their lower ends toward their upper ends. Four lower baffles may be located above the four lower corners, respectively, with each lower baffle covering one of the lower corners and extending laterally inward and downward from the peripheral wall, so as to divert material traveling downward toward the lower corners laterally inward and thus across the width of the paving machine conveyor.

The perimeter wall may further include at least one corner wall joining each two adjacent major walls so that the open upper end is polygonal having at least eight sides.

The height of the asphalt material piled on top of the grate increases the weight forcing the asphalt material through the grate thus enhancing a reduction in average clump size of the asphalt material as it passes through the grate.

The grate may also capture foreign material and prevent the foreign material from flowing downward into the paving machine conveyor where it might be conveyed under the paving device and thus damage the new pavement.

The variable width spacing between the upper baffles may serve to laterally spread the asphalt material to different widths along a length of the grate. This aids in avoiding the creation of a concentration of segregated large aggregate material adjacent the edges of the paving conveyor located below the lower outlet of the hopper insert.

The downward outward flare between the upper baffles may reduce bridging of the asphalt material between the upper baffles thus allowing free flow of the asphalt material.

The upper baffles may function as retainer walls which provide an arrangement which allows a user to selectively fill the hopper insert to one of two optional fill levels. The first optional smaller fill level involves depositing the asphalt material only between the two retainer walls without allowing the asphalt material to overflow the retainer walls. The second larger optional fill level involves allowing the asphalt material to overflow the retainer walls so that the deposited asphalt material is also received within a lateral volume between each of the retainer walls and the peripheral wall of the hopper insert.

By forming the grate as an island grate, bypass zones are defined on opposite sides of the island grate but still between the upper baffles so as to allow a flow path for asphalt material in the event of bridging of the asphalt material on top of the grate or some portion thereof.

Numerous objects, features and advantages of the present invention will be readily apparent to those skilled in the art upon a reading of the following disclosure when taken in conjunction with the accompanying drawings.

DETAILED DESCRIPTION

Figure 1:
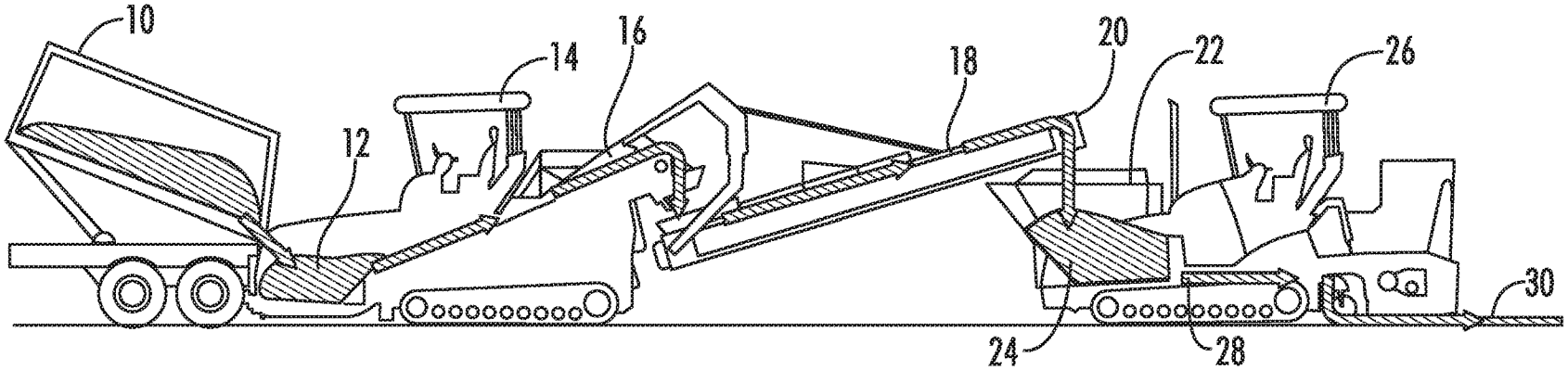
FIG. 1 is a schematic view of the various equipment utilized in an asphalt paving job, including a dump truck, a material transfer vehicle, and an asphalt paving machine including a hopper insert.

FIG. 1 schematically illustrates the major items of equipment utilized in an asphalt paving job. A dump truck 10 is shown depositing asphalt material into a receiving bin 12 of a material transfer vehicle 14.

The material transfer vehicle 14 conveys the asphalt material up a first conveyor 16 to a second conveyor 18. Material exits the upper end 20 of the second conveyor 18 into a hopper insert 22 constructed in accordance with the present invention. The hopper insert 22 is received within an integral hopper 24 on the front of an asphalt paving machine 26. The asphalt paving machine 26 has a horizontally extending conveyor schematically indicated at 28 which runs under the bottom of the integral hopper 24 and carries the asphalt material to the rear of the paving machine 26 where the asphalt material is laid down to form a newly laid asphalt layer 30.

Figure 1A:
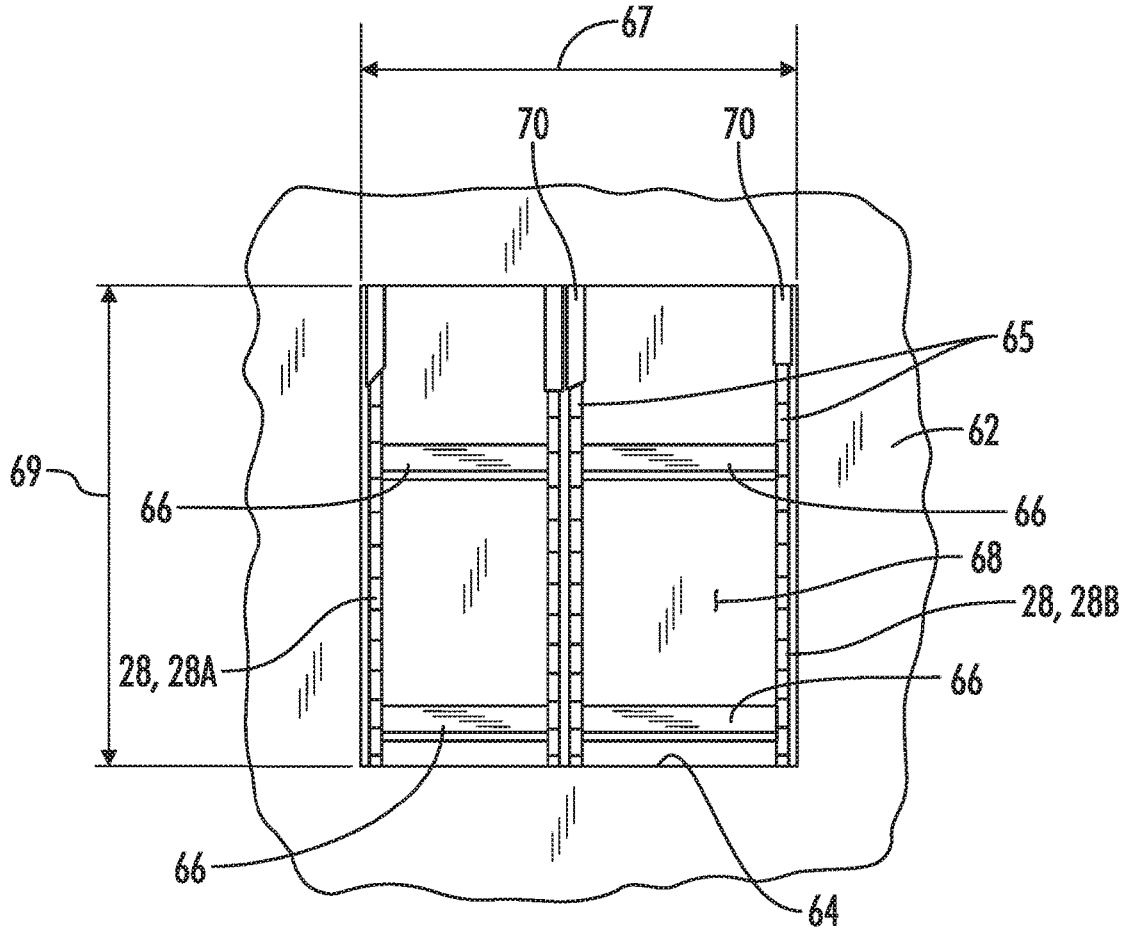
FIG. 1A is a schematic plan view of the integral receiving bin or hopper of an asphalt paving machine, showing the conveyor opening of the asphalt paving machine.

As schematically illustrated in FIG. 1A, the integral hopper 24 of the material transfer vehicle 26 may have a floor 62 with a conveyor opening 64 formed therein. The paving machine conveyor 28 may include two parallel chain flight conveyors 28A and 28B. Each chain flight conveyor includes a pair of parallel spaced chains such as 65 having a plurality of flight bars such as 66 extending therebetween. The flight bars 66 are carried from front to rear by the moving chains 65 so that the flight bars 66 slide across a fixed conveyor plate 68 to convey the asphalt material from front to rear through the paving machine 26. The chains 65 may be covered by chain cover members such as 70 to protect them from the particulate material. Typical openings 64 may have a width 67 of approximately 48 inches and a length 69 of approximately 54 inches.

Figure 2A:
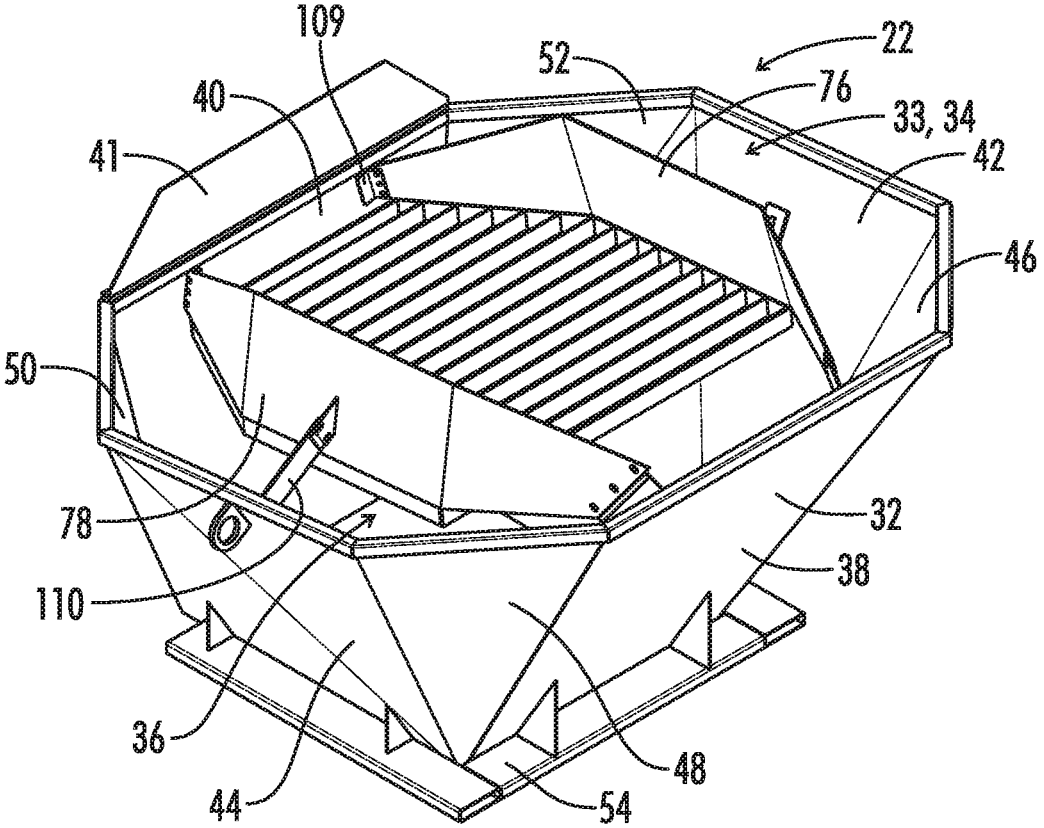
FIG. 2A is a schematic perspective view of one embodiment the hopper insert of the present invention in which the upper baffles extend above the open upper end of the hopper insert.
Figure 2B:
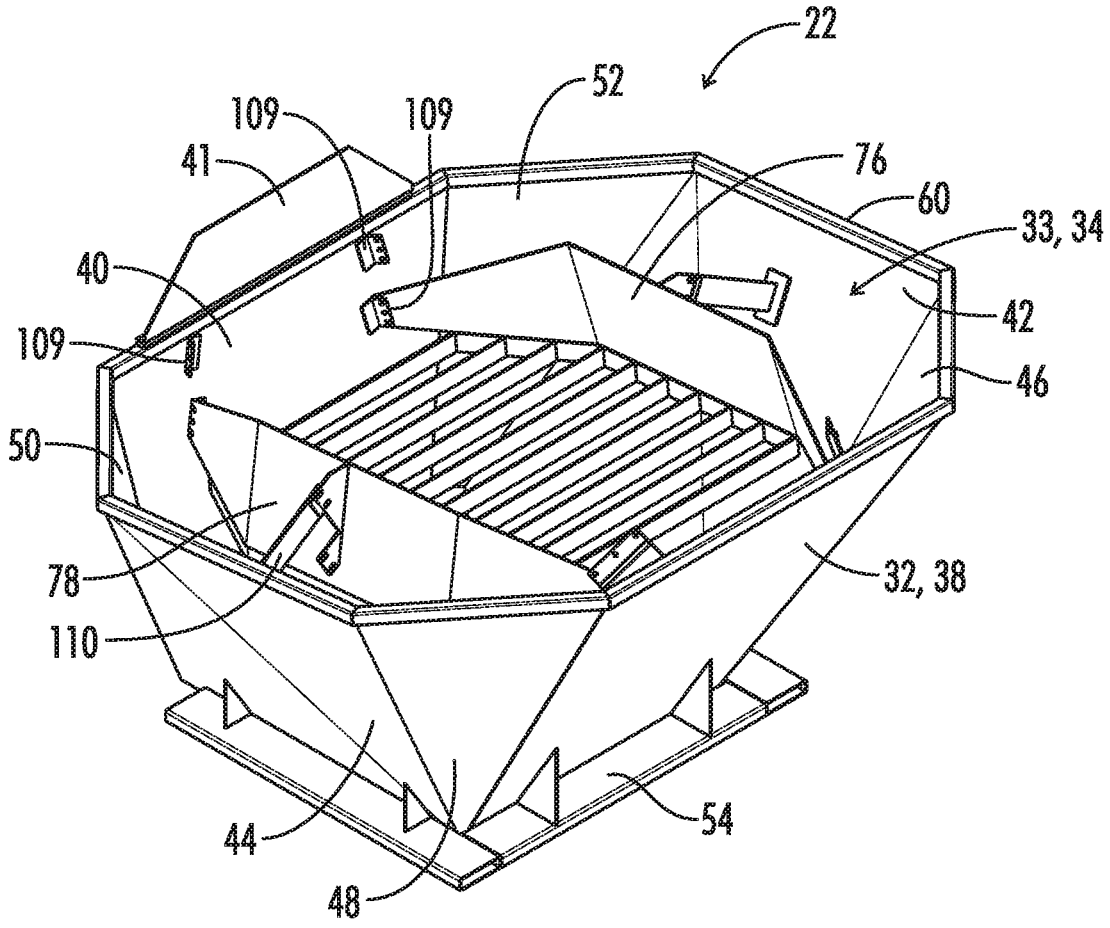
FIG. 2B is a schematic perspective view of another embodiment the hopper insert of the present invention in which the upper baffles do not extend above the open upper end of the hopper insert.
Figure 3A:
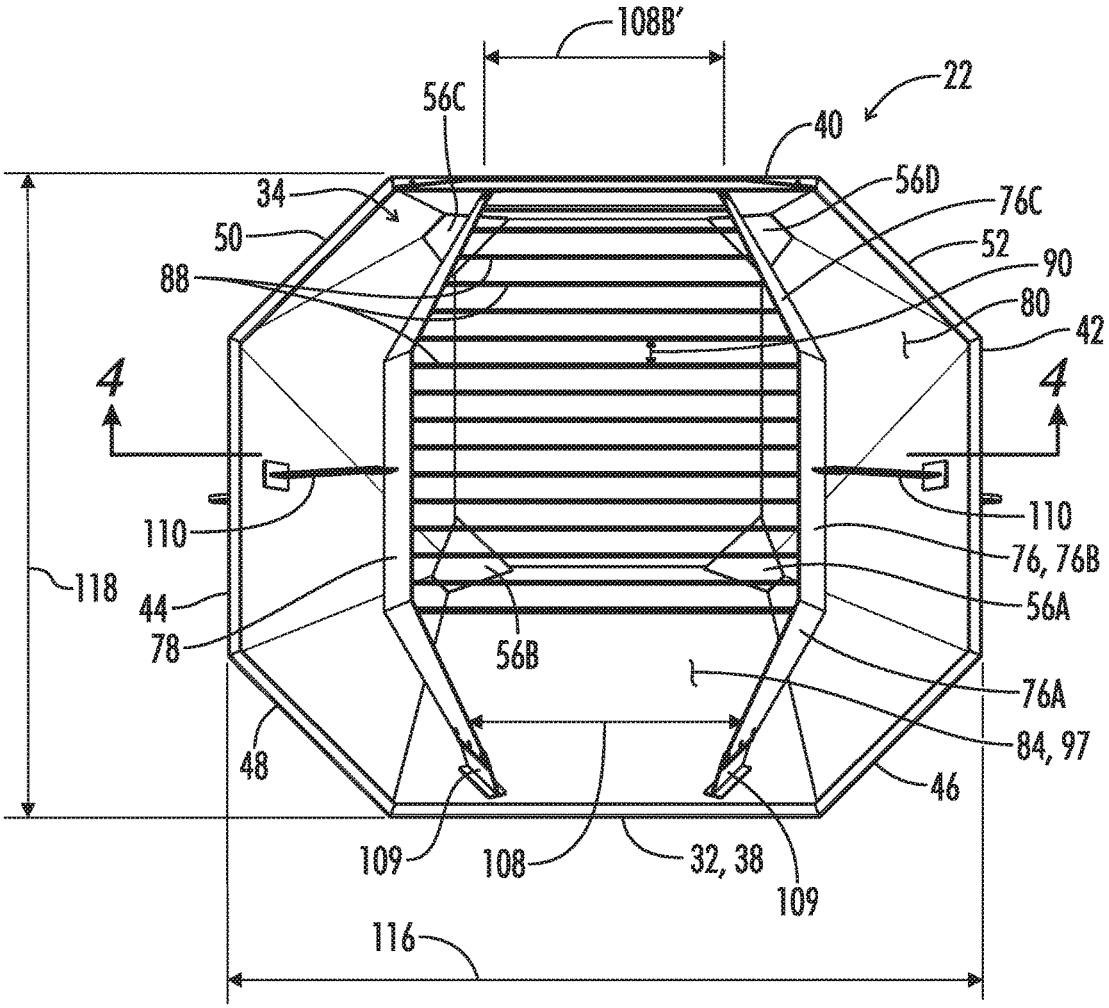
FIG. 3A is a top plan view of the hopper insert of FIG. 2A. The grate is peninsula shaped having one bypass zone adjacent the grate.
Figure 3B:
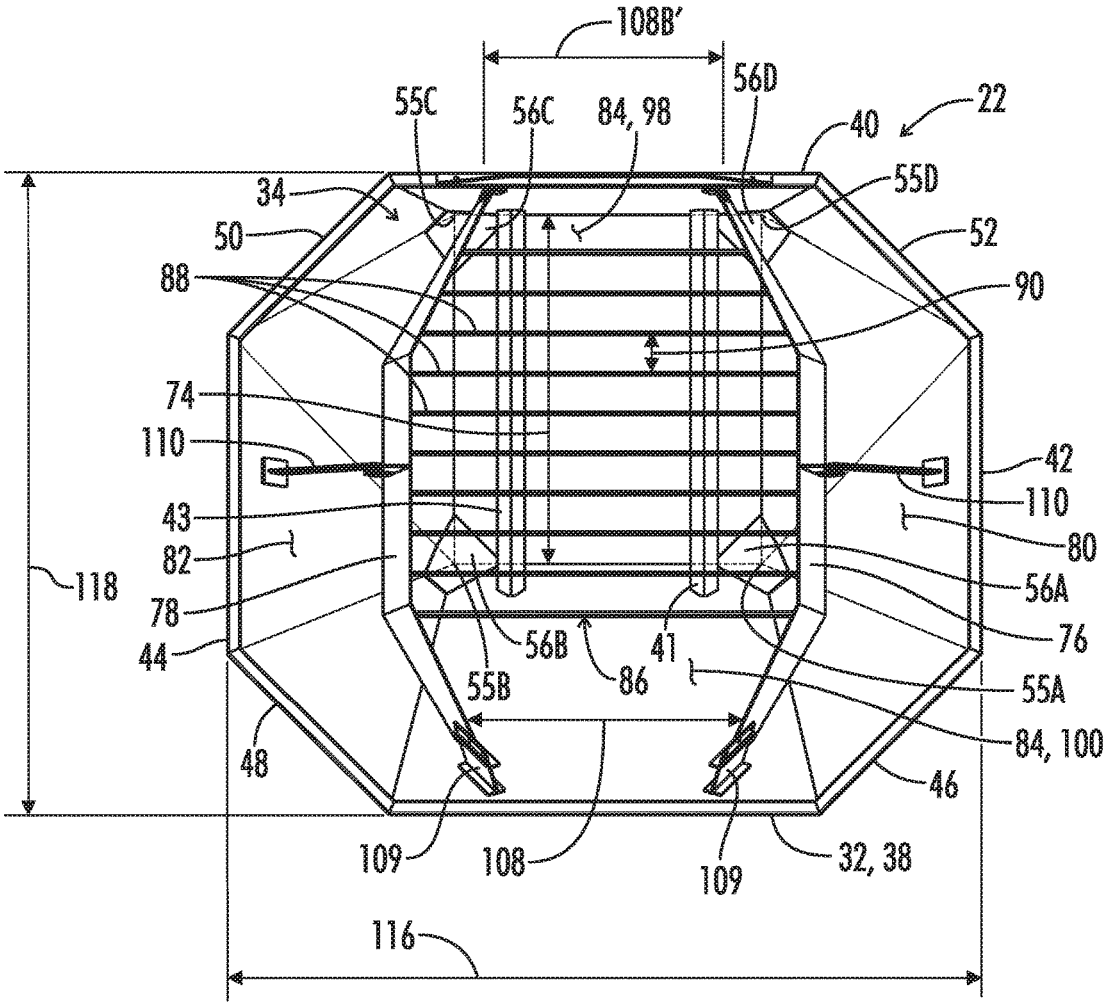
FIG. 3B is a top plan view of the hopper insert of FIG. 2B. The grate is island shaped having two bypass zones on opposite sides of the grate.

Details of construction of one embodiment of the hopper insert 22 are shown in FIGS. 2A, 3A, 4 and 5. A second embodiment of the hopper insert 22 illustrating several optional features is seen in FIGS. 2B and 3B. In the embodiment of FIGS. 2A and 3A, the upper baffles extend above the upper edge of the hopper insert, whereas in the embodiment of FIGS. 2B and 3B the upper baffles are located lower within the interior of the hopper insert. In the embodiment of FIGS. 2A and 3A, the grate is peninsula shaped, whereas in the embodiment of FIGS. 2B and 3B the grate is island shaped. Also, in the embodiment of FIGS. 2A and 3A there are more grate bars which are spaced closer together than is the case in the embodiment of FIGS. 2B and 3B. For similar components of the two embodiments, the same identifying numerals are used in the Figures.

The hopper insert 22 includes a perimeter wall 32 defining a hopper insert interior 33 having an open upper end 34 and an open lower end 36. The perimeter wall 32 includes a front wall portion 38, a rear wall portion 40, a left side (from the perspective of the operator of the paving machine 26) wall portion 42, a right side wall portion 44, a left front corner wall portion 46, a right front corner wall portion 48, a right rear corner wall portion 50, and a left rear corner wall portion 52.

The front wall portion 38, rear wall portion 40, left side wall portion 42, and right side wall portion 44 may be generally referred to as four major wall portions. By the term "major wall portion" it is meant that these four wall portions have a longer perimeter on their upper edges than do the other wall portions. In one embodiment, the four major wall portions may be rectangular plates. In another embodiment they may be trapezoidal in shape. In another embodiment each of the side wall portions such as 44 may be made of two triangular plates such as 44A and 44B seen in FIG. 5

In an embodiment, the four corner wall portions 46, 48, 50 and 52 may be triangular shaped plates as shown.

The open upper end 34 may be polygonal in shape having eight sides. The lower open end 36 may be four sided. With the use of the lower baffles 56 described below, the lower open end 36 may be considered to be eight sided.

Figure 5:
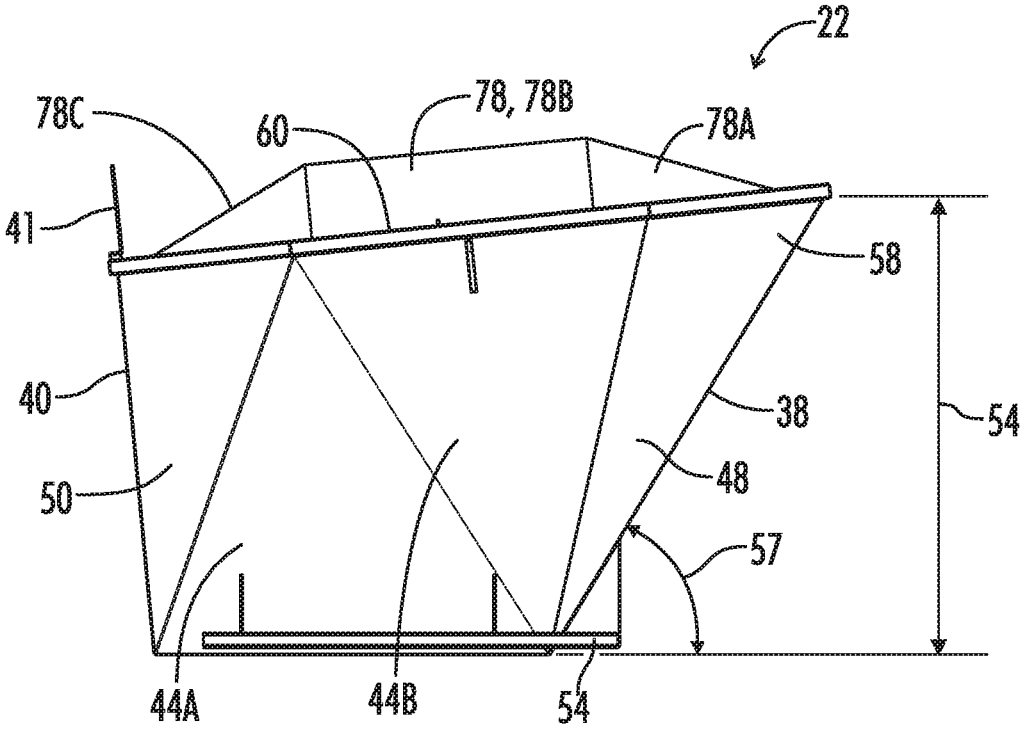
FIG. 5 is a right side elevation view of the hopper insert of FIG. 2A.

As seen in FIG. 5, the hopper insert 22 may include an upper extension plate or back plate 41 on the rear wall portion 40 extending substantially vertically upward above the top edge of the perimeter wall 32. The back plate 41 serves as a back stop to retain asphalt material in the hopper insert 22 when that material is being fed into the hopper insert 22 from the conveyor 18 of the material transfer vehicle 14.

A generally horizontal extending lower flange 54 may extend outward from near the lower end of the perimeter wall 32 to provide a base for supporting the hopper insert on the floor 62 of the integral hopper 24 of the paving machine 26. The lower edge of the perimeter wall 32 may extend slightly below the flange 54 to aid in centering the hopper insert 22 in the opening 64 of the paving machine conveyor 28 seen in FIG. 1A. The lower flange 54 may also support the hopper insert on top of the active remixing module 122 described below with regard to FIGS. 9-10.

The four major walls 38, 40, 42 and 44 may be joined together at their lower ends to define the open lower end 36 of the hopper insert 22 as a four sided opening having four lower corners 55A, 55B, 55C and 55D, as seen in dashed lines in FIG. 3B.

In the embodiment of FIG. 3B optional flow diverters 41 and 43 are shown between the lower ends of front wall portion 38 and rear wall portion 40. These flow diverters are not present in the embodiment of FIG. 3A.

Figure 4:
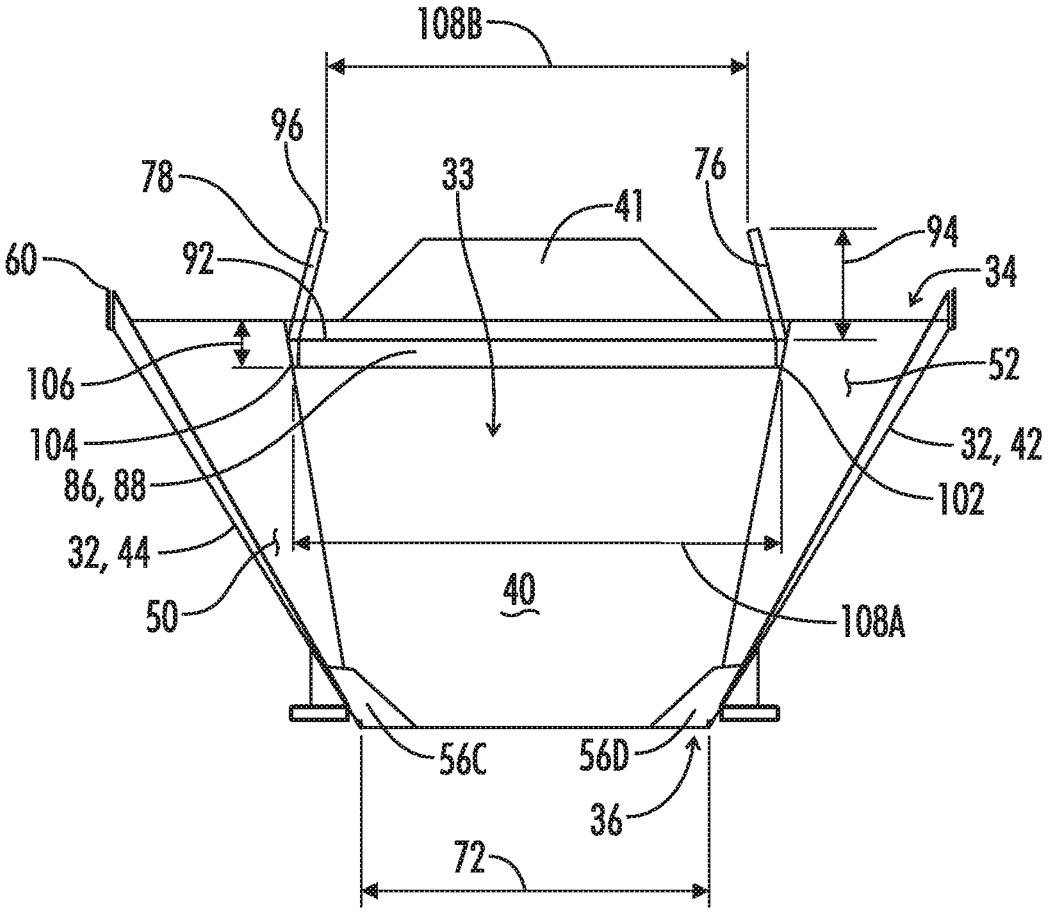
FIG. 4 is a cross-section elevation view taken along line 4-4 of FIG. 3A.

As best seen in FIG. 4, the four major walls slope away from each other along at least a part of a wall height 54 from their lower ends toward their upper ends so that the open upper end 34 is larger than the open lower end 36. Located above each of the four corners 55A, 55B, 55C and 55D are lower baffles 56A, 56B, 56C and 56D, respectively, each of which covers one of the lower corners and extends laterally inward and downward from the peripheral wall 32. These lower baffles 56A-D serve to divert any material traveling downward in the area of the corners 55A-D laterally inward across the width of the lower opening 36.

Each of the lower baffles 56 may be formed from a generally trapezoidal shaped steel plate welded to the inner surfaces of three converging walls. For example, the lower baffle 56C as seen in FIGS. 3A and 4, is welded to walls 40, 50 and 44 and extends laterally inward from those walls over the lower corner 55C of what would otherwise be the lower opening 36 of the hopper insert.

It is noted that depending upon the size of the lower baffles 56A-D and their proximity to the lower end of the perimeter wall 32, the lower baffles 56A-D may also be considered to partially define the shape of the open lower end 36 in which case the open lower end 36 may be considered to be eight sided.

As best seen in FIG. 5, the front wall portion 38 slopes at a significantly greater angle 57 than the rear wall portion 40, thus creating a large front overhang area 58 to increase the capacity of the hopper insert 22. As is also apparent in FIG. 5, the height 54 of the perimeter wall 32 may decrease from the front wall 38 toward the rear wall 40 so that an upper edge 60 of the side wall such as 44 is sloped downward from front to rear.

In one embodiment, the four sided lower opening 36 of hopper insert 22 may be dimensioned to substantially correspond to typical dimensions of the floor opening 64 above the conveyor 28 of the paving machine 26.

The hopper insert 22 may include first and second upper baffles 76 and 78 extending across the open upper end 34 of the hopper insert 22 and supported from the front and rear wall portions 38 and 40 of perimeter wall 32. As is best appreciated in the side elevation view of FIG. 5, for the embodiment of FIGS. 2A and 3A each of the upper baffles 76 and 78 includes at least a central portion 76B and 78B, respectively, extending higher than the upper edge 60 of the perimeter wall 32.

As is best seen in the plan views of FIGS. 3A and 3B, the upper baffles 76 and 78 and particularly their central portions 76B and 78B are spaced transversely away from the perimeter wall 32 and particularly from the corresponding side walls 42 and 44, respectively, of the perimeter wall 32. This defines lateral volumes 80 and 82, respectively, within the perimeter wall 32 between the upper baffles 76 and 78 and portions of the perimeter wall 32.

As also seen in FIGS. 3A and 3B, the first and second upper baffles 76 and 78 define an interior portion 84 of the cross-sectional area of the interior 33 adjacent the open upper end 34 having an interior portion cross-sectional area less than the upper end cross-section area of the open upper end 34.

As seen in FIGS. 3A and 4, a grate 86 covers at least a part of the interior portion 84 of the open upper end 34. The grate 86 may include a plurality of parallel grate bars 88 spaced apart from each other by a spacing 90 which preferably is in a range of from about 3 inches to about 8 inches, and more preferably in a range of from about 4 inches to about 6 inches. In the embodiments illustrated in FIGS. 3A and 3B, the grate bars 88 extend transversely between the first and second upper baffles 76 and 78. The embodiment of FIG. 3A illustrates 16 grate bars at a 4 inch grate spacing. The embodiment of FIG. 3B illustrates 10 grate bars at a 6 inch grate spacing. In general, the grate 86 may be described as having at least six grate bars 88, and more preferably at least eight grate bars, and most preferably at least ten grate bars.

Although the grate bars 88 are shown in the illustrated embodiments as extending transversely between the generally lengthwise arranged upper baffles 76 and 78, other patterns and arrangements of the grate bars 88 may be used. For example, the grate bars 88 could run lengthwise substantially parallel to the central portions of the baffles 76 and 78 with the forward and rearward ends of the grate bars being supported by a suitable cross member extending between the baffles 76 and 78. Optionally, the grate bars could be oriented obliquely relative to the length or width of the hopper insert 22. Optionally, the grate 86 does not have to be constructed simply with parallel grate bars, but the grate could be arranged in a grid or other pattern. The controlling factor is to provide an arrangement with appropriate spacing and shapes of spacing between the grate bars so that any clumps in the asphalt material will break and pass through the grate bars.

The baffles 76 and 78 may also be referred to as first and second grate boundary walls 76 and 78 or as opposed lateral retaining walls 76 and 78, extending along opposite sides of the grate 86 and attached to opposite sides 38 and 40 of the peripheral wall 32. The baffles 76 and 78 retain the asphalt material piled on top of the grate 86.

As best seen in FIG. 4, the grate 86 defines an upper grate surface 92 which is preferably located a distance 94 of at least 6 inches, more preferably at least 12 inches, and most preferably about 18 inches, below an uppermost extent or upper edge 96 of the central portion of the upper baffles 76 and 78.

As is best seen in FIG. 3A, the grate 86 may be dimensioned so that it is superimposed over a majority of the open lower end 36 of the hopper insert 22. More preferably the grate 86 may be superimposed over at least about 80%, and even more preferably at least about 90% of the open lower end 36. The grate 86 may be superimposed over the entire open lower end 36.

Preferably, the grate 86 is spaced from the perimeter wall around at least a majority of the perimeter wall 32. In the embodiment of FIGS. 2A and 3A, the grate may be described as a peninsula shaped grate have one grate bypass 97 adjacent the grate.

Optionally, the grate 86, as shown in FIGS. 2B and 3B, may be an island grate that is spaced from the perimeter wall around the entire periphery of the perimeter wall 32. Such an island grate creates two grate bypasses 98 and 100 on opposite sides of the grate 86 but within the interior zone 84 between the upper baffles 76 and 78.

The bypass zones 97, 98 and 100 will allow asphalt material to bypass the grate 86 if the grate 86 were to become plugged or bridged over with asphalt material. This ensures that a paving job can continue, even if under less than ideal conditions, if a bridging or plugging problem occurs.

As best seen in FIG. 4, a lower edge such as 102 and 104 of the upper baffles 76 and 78, respectively, and particularly of the central portions thereof are located at a distance 106 lower than the upper edge 60 of the open upper end 34 closest to any respective portion of the upper baffles.

As is also shown in FIG. 4, the first and second upper baffles 76 and 78 flare downwardly away from each other. This aids in preventing asphaltic material from plugging over or bridging the grate.

As best seen in FIGS. 3A and 3B, a transverse spacing generally identified as 108 between the upper baffles 76 and 78 varies along a length of the upper baffles 76 and 78, that is in the direction from front to rear or rear to front of the hopper insert 22.

In the embodiments illustrated, each of the upper baffles 76 and 78 may be formed from a bent plate of steel, wherein central portions 76B and 78B of the baffles run substantially front to rear and are parallel to each other. Forward portions 76A and 78A, and rearward portions 76C and 78C of each baffle are bent laterally inward toward the opposed baffle such that starting from front to rear, the transverse spacing 108 between baffles 76 and 78 increases from the front wall portion 38 toward the rear, until the central portions 76B and 78B of the baffles are reached, at which point the spacing 108 becomes constant across the central portion of the hopper insert 22, and then the spacing 108 becomes smaller as the rear wall 40 is approached. This arrangement aids in preventing aggregate material from gathering in a straight line adjacent the lower lengthwise sides of the bottom opening 36 and in general spreads any segregated aggregate over the width of the hopper insert 22 as the aggregate flows downward through the hopper insert 22. The upper baffles may also be formed of multiple sheets of material joined together.

In the embodiments illustrated in FIGS. 3A and 3B the front and rear ends of the baffles 76 and 78 are attached to the front and rear wall portions 38 and 40, respectively, of the perimeter wall 32. The attachment of baffles 76 and 78 to the wall portions may be by bolts or other suitable fasteners to attach the baffles to mounting tabs such as 109 welded on the interior of the perimeter wall 32. Additionally, lateral braces such as 110 may extend between the side walls 40 and 44 and the adjacent upper baffles.

An alternative lower mounting position for the grate 86 and upper baffles 76 and 78 is shown in FIG. 2B. There it is seen that the grate 86 and upper baffles 76 and 78 may be mounted so that the upper edges of the central portions of the baffles 76 and 78 are substantially parallel to and in the same plane as the upper edge 60 of the perimeter wall 32. This provides a lower capacity fill mode and can be achieved simply by providing lower mounting tabs 109 as seen in FIG. 2B.

Passive Remixing

As will be understood by those skilled in the art, asphalt material is comprised of an asphaltic binder mixed with sand and aggregate materials of various sizes. When the asphalt material is mixed in the asphalt production plant from which it is obtained by the trucks 10 shown in FIG. 1, the asphalt material has a relatively uniform distribution of the aggregate materials of various sizes throughout the matrix of asphaltic binder material, and the asphalt material has been heated to a relatively uniform temperature throughout the mixture.

The hot uniform asphalt mixture is then deposited in the trucks 10 which must carry it as quickly as possible to the job site. Two things happen during transport of the asphalt material and during handling of the asphalt material as it is transferred into the truck 10, then from the truck 10 to the material transfer vehicle 14, then from the material transfer vehicle 14 to the asphalt paving machine 26. The material will be subject to non-uniform cooling, particularly while it is sitting in the bed of the truck 10. This problem is exacerbated if the truck 10 must travel a long distance to the job site or if traffic delays are encountered. This non-uniform cooling of the asphalt mixture will allow relatively cool crusts or clumps to form on the surface and the sides of the piled up asphalt material.

Additionally, as the asphalt material is handled, it tends to segregate, and particularly the larger aggregate material at the top of the pile will tend to roll down sloped surfaces of the pile and tend to gather along the edges of any container or conveying device.

Thus it is desirable to avoid such physical and thermal segregation of the asphalt material as it is handled. Through appropriate design the segregation process can even be reversed so that the asphalt material is remixed as it is handled.

Numerous features of the hopper insert 22 contribute to passive remixing of the asphalt material as it flows downward through the hopper insert 22.

First, by depositing the asphalt material on top of the grate 86 and then piling additional asphalt material on top of the grate to increase the pressure on the material resting on the immediate top surface 92 of the grate 86, any larger clumps of material which have formed during the transport procedure will tend to be broken apart by the grate 86 thereby reducing the average size of any clumps of asphalt material as the material flows through the grate 86. To that end, the upper edges of the grate bars 88 are preferably relatively sharp edges to aid in breaking apart the clumps of asphalt material.

Also, as any clumped asphalt material is broken into smaller clumps, this will reduce thermal segregation of the material as the smaller clumps can more easily absorb heat from surrounding hotter asphalt mixture as the material flows downward through the hopper insert 22. Thus clump size reduction and remixing are achieved passively, and the expense of active remixing equipment may often be avoided.

Additionally, the variable width 108 between the upper baffles 76 and 78 prevents any collection of larger aggregates against the upper baffles from being aligned with the length of the hopper insert 22 and thus with the left and right edges of the lower opening 36 thereof. This distributes any such collected aggregate material over a portion of the width of the hopper insert.

Additionally, if the hopper insert 22 is loaded in a first lower capacity mode as further described below with regard to FIG. 6, the length of the slope on top of the aggregate pile is reduced at least in the lateral direction, which further aids in minimizing the segregation of larger aggregate materials as they are handled.

Also, the eight sided construction of the upper portions of the perimeter wall 32 reduces material from collecting or stagnating in the typical square corners of typical prior art four sided hopper inserts.

Additionally, any aggregate material that does tend to collect as it flows downward toward the lower corners 55A-55D of the four sided opening 36 is deflected laterally inward by the lower baffles 56A-56D as that material nears the lower outlet opening 36.

All of these features working together contribute to the elimination or reduction of the collection of segregated aggregate material along the left and right edges of the conveyor opening 64 into which the material flows when it flows out of the lower opening 36 of the hopper insert 22.

Additionally, the hopper insert 22 is designed to prevent or reduce the possibility of asphalt material plugging the grate 86 or bridging the grate 86. First, the downward outward flare of the opposed upper baffles 76 and 78 as seen in FIG. 4 tends to prevent the pile of asphalt material from wedging against the baffles 76 and 78 and thus aids in preventing plugging or bridging over of the grate 86. Additionally, the presence of the grate bypass zones such as 97, 98 and 100 provides a flow path for the asphalt material in the event the grate 86 does partially or completely plug, thus allowing a paving job to continue until the hopper insert 26 can be cleaned out to remove any plugging.

Figure 7:
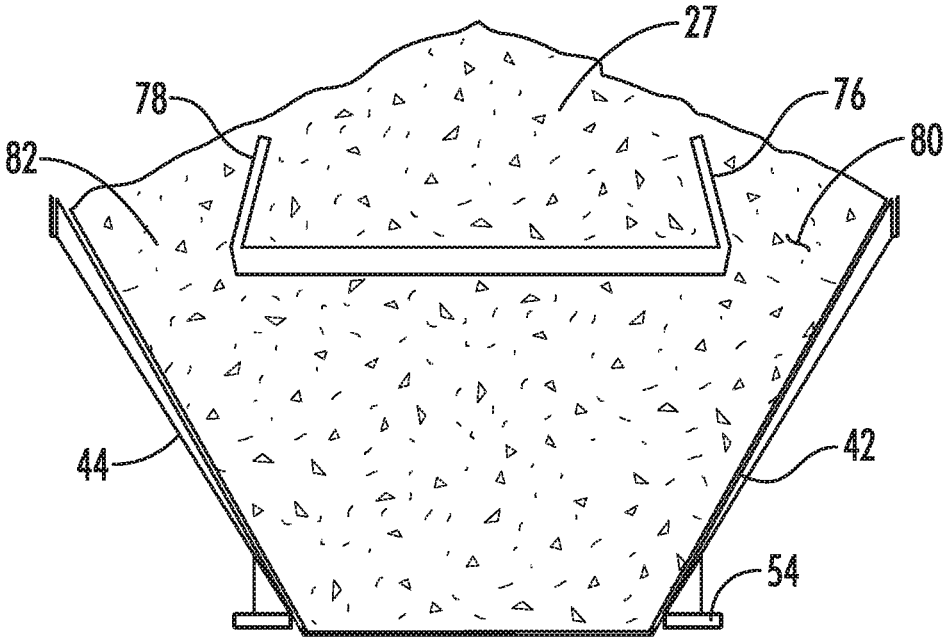
FIG. 7 is a view similar to FIG. 6 showing the hopper insert filled to a second optional larger fill level wherein the asphalt material is allowed to overflow the upper baffles.

The upper baffles 76 and 78 will cause most of the asphalt material loaded into the hopper insert 22 to flow between the baffles 76 and 78, even when filling the hopper insert to the optional larger fill level of FIG. 7, thus substantially minimizing the collection of larger stones or aggregate material adjacent the side walls 42 and 44 of the hopper insert as the material flows downward from the upper opening 34 to the lower opening 36.

Dual Capacity Modes

Another feature provided by the upper baffles 76 and 78 is the ability to load the hopper insert to either one of two optional loading capacities.

Figure 6:
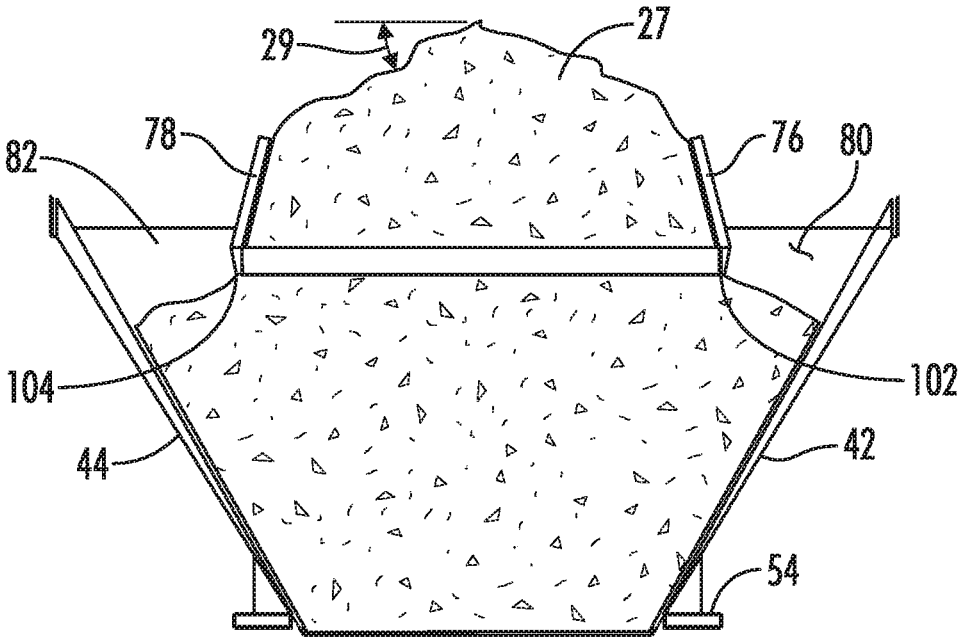
FIG. 6 is a cross-section view similar to FIG. 4 schematically illustrating the hopper insert filled to a first optional lower fill level wherein the asphalt material is not allowed to overflow the upper baffles.

The dual capacity feature of the hopper insert 22 is best understood in comparing FIGS. 6 and 7. FIGS. 6 and 7 schematically illustrate a smaller and larger optional fill level, respectively, for the hopper insert 22.

In the smaller fill level schematically illustrated in FIG. 6, the asphalt material is deposited on top of the grate 86 only between the two upper baffles 76 and 78 without allowing the asphalt material to overflow the upper baffles 76 and 78. Thus a cross-section of the asphalt pile will tend to take the shape shown in FIG. 6 where the material is piled highest in the interior zone 84 between the upper baffles 76 and 78 and the pile of asphalt material may achieve its natural angle of repose 29 on its top surface only between the baffles 76 and 78. Below the level of the lower edges 102 and 104 of baffles 76 and 78, the asphalt material can spread out to the entire cross-section of the hopper insert 22, but the lateral volumes 80 and 82 between the baffles and the perimeter wall are not filled.

The optional second greater fill level is achieved by allowing the asphalt material to overflow the upper baffles 76 and 78 so that the asphalt material is also received within the lateral volumes 80 and 82 as seen in FIG. 7.

Thus, by the presence of the upper baffles 76 and 78, the operator of the material transfer vehicle 14 can readily visually observe and control the maximum fill level of the hopper insert 22 to achieve a selected one of the two optional fill levels. As will be understood by those skilled in the art, in some situations, it may be undesirable for the paving machine 26 to carry the full weight of the hopper insert 22 filled to the optional greater fill level, and thus a controllable known lower fill level is easily achieved by simply observing the asphalt material and terminating the load before the asphalt material is allowed to overflow the upper baffles 76 and 78.

EXAMPLE

In one embodiment of the hopper insert 22 the open lower end 36 may have a width 72 of approximately 48 inches and a length 74 of approximately 54 inches which substantially corresponds to the dimensions of a typical conveyor opening 64 as seen in FIG. 1A. The lateral spacing 108 between upper baffles 76 and 78 will have a maximum value in the central portion, and as seen in FIG. 4 will be different at the top of the baffles as compared to the bottom of the baffles. Thus between the central portions 76B and 78B of the baffles 76 and 78 as seen in cross-section in FIG. 4, the baffles may have a lower baffle spacing 108A at their lower edges of approximately 70 inches and an upper baffle spacing 108B of approximately 60 inches.

Then, at the forward and rearward walls 38 and 40 the upper baffle spacing 108B may taper down to a minimum value 108B' with a corresponding tapered reduction in the lower spacing 108A.

The open upper end 34 of hopper insert 22 may have a width 116 of approximately 118 inches, and a length 118 of approximately 100 inches.

The hopper insert 22 may have a height 54 above the elevation of lower end opening 36 of approximately 53 inches at the rear wall portion 40 and approximately 63 inches at the forward wall portion 38.

The baffles 76 and 78 may extend a distance 94 of approximately 18 inches above the grate 86, and the lower edges 102 and 104 of the baffles 76 and 78 may be located a distance 106 of approximately 6 inches below the upper edge of the adjacent side walls of the peripheral wall 32. The grate upper surface 92 may be arranged substantially parallel to the top edge 60 of the perimeter wall 32, thus providing a slight rearward tilt of the grate upper surface 92.

With the hopper insert 22 dimensioned as just described in this example, when the hopper insert 22 is filled to the first lower fill level schematically illustrated in FIG. 6, it will have a fill volume of approximately 9.2 $yd^3$.

When the hopper insert 22 is filled to the optional second larger fill level schematically illustrated in FIG. 7, wherein the asphalt material is allowed to overflow the upper baffles 76 and 78 thus filling the lateral volumes 80 and 82, the volume of material contained within the hopper insert 22 is approximately 11 $yd^3$.

Thus the use of the upper baffles 76 and 78 provides a dual loading capacity without the use of an add-on extension as is typically used in the prior art. This avoids the problem of having to bolt on the add-on extension or of the unavailability of the add-on extension when it is needed, and it avoids the time delay involved in adding a bolt-on extension to a hopper insert. And by appropriate design, passive remixing is provided as the material flows through the hopper insert without any additional operating cost.

Figure 8:
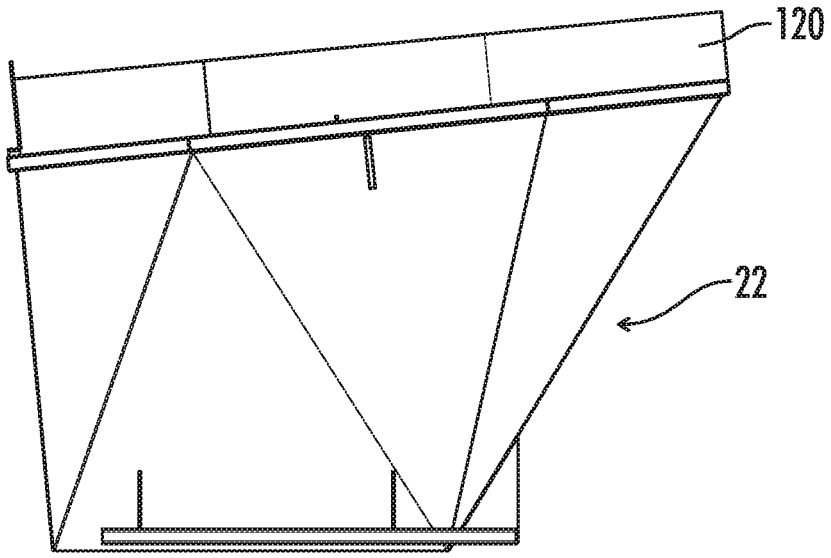
FIG. 8 is a schematic right side elevation view showing an upper hopper extension.
Figure 9:
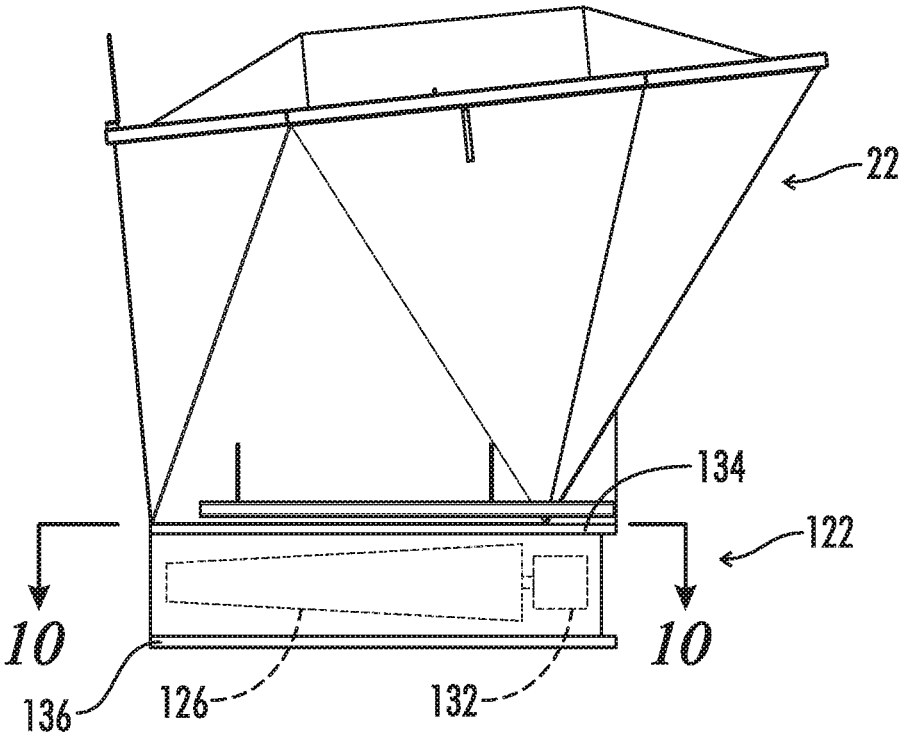
FIG. 9 is a schematic right side elevation view showing an active remixing module mounted below the hopper insert.
Figure 10:
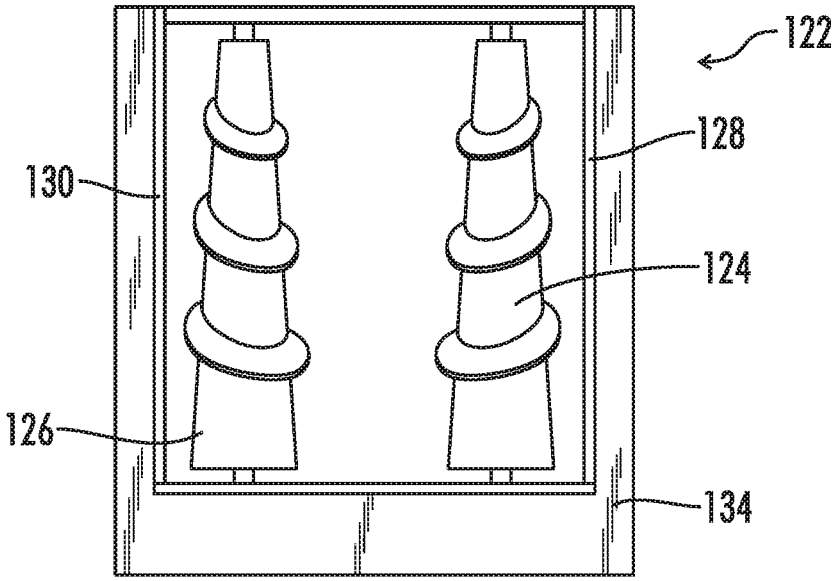
FIG. 10 is a schematic plan view of the active remixing module of FIG. 9.

Optional Features of FIGS. 8-10

If even greater capacity is required for the hopper insert 22 a vertical extension module 120 may be bolted onto the upper end of hopper insert 22 as schematically illustrated in FIG. 8. The vertical extension module 120 may have a shape in plan view substantially identical to the shape of the top end of hopper insert 22 and can be bolted to the hopper insert 22 as a module in a known manner.

Additionally, in some job applications where severe problems of aggregate segregation occur during the transport of the aggregate material to the job site, it may be desired to add an active remixing module 122 to the lower end of the hopper insert 22 as schematically illustrated in FIG. 9.

FIG. 10 shows a schematic plan view of the active remixing module 122 which may for example include two conical augers 124 and 126 extending lengthwise near the side walls 128 and 130 of the module 122. The placement of the augers adjacent the side walls 128 and 130 will provide an active remixing of any larger aggregate materials that have segregated and collected adjacent the hopper insert side walls 42 and 44, thus preventing lines of segregated material from forming adjacent the lengthwise sides of conveyor opening 64.

The auger 126 is schematically illustrated in dashed lines in FIG. 9, along with a hydraulic drive motor 132. Each of the augers will have a drive motor 132, and the drive motors may be powered from the hydraulic system of the paving machine 26. Optionally electric drive motors or any other suitable drive power source may be used for the augers.

The active remixing module 122 may include an upper flange 134 that connects to the flange 54 of hopper insert 22. The module 122 may have a lower flange 136, similar in shape to flange 54 of hopper insert 22, for resting on the floor 62 of paving machine 26, with the open bottom end of the module 122 opening into the conveyor opening 64.

For those extreme job situations requiring the additional remixing function of the active remixing module 122, the module 122 may be used only when needed and in these extreme situations the active remixing is providing at the last point of handling of the asphalt material before it is actually received on the conveyor 28 of the asphalt paving machine 26, thus providing the active remixing at the most effective point in the flow path of the material. This is contrasted to various prior art systems which use active remixing at earlier stages of the material handling.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A method of passive mixing of asphalt material with a hopper insert for an asphalt paving machine, the hopper insert including a larger upper open end and a smaller lower open end so that the hopper insert is funnel shaped, the method comprising:

(a) receiving the asphalt material on top of a grate located nearer to the upper end than to the lower end of the hopper insert;

(b) reducing an average clump size of the asphalt material as at least a portion of the asphalt material passes through the grate; and (c) discharging the asphalt material out the smaller lower open end of the hopper insert onto a conveyor of the asphalt paving machine;

wherein step (a) further comprises piling the asphalt material on the grate to a depth of at least 12 inches to increase a weight forcing the asphalt material through the grate; and wherein step (a) further comprises retaining the piled asphalt material on the grate with at least two opposed lateral retainer walls on opposite sides of the grate, the retainer walls being laterally spaced from a peripheral wall of the hopper insert.

2. The method of claim 1, further comprising:

laterally spreading the asphalt material to different widths along a length of the grate via a variable lateral spacing between the retainer walls.

3. The method of claim 1, further comprising:

reducing bridging of the asphalt material between the retainer walls via a downward outward flare of the retainer walls relative to each other.

4. A method of passive mixing of asphalt material with a hopper insert for an asphalt paving machine, the hopper insert including a larger upper open end and a smaller lower open end so that the hopper insert is funnel shaped, the method comprising:

(a) receiving the asphalt material on top of a grate located nearer to the upper end than to the lower end of the hopper insert;

(b) reducing an average clump size of the asphalt material as at least a portion of the asphalt material passes through the grate; and (c) discharging the asphalt material out the smaller lower open end of the hopper insert onto a conveyor of the asphalt paving machine;

wherein step (a) further comprises retaining at least a portion of the asphalt material on the grate between at least two opposed lateral retainer walls on opposite sides of the grate, the retainer walls being laterally spaced from a peripheral wall of the hopper insert; and further comprising:

filling the hopper insert to a smaller one of two optional fill levels by depositing the asphalt material only between the two retainer walls without allowing the asphalt material to overflow the retainer walls.

5. A method of passive mixing of asphalt material with a hopper insert for an asphalt paving machine, the hopper insert including a larger upper open end and a smaller lower open end so that the hopper insert is funnel shaped, the method comprising:

(a) receiving the asphalt material on top of a grate located nearer to the upper end than to the lower end of the hopper insert;

(b) reducing an average clump size of the asphalt material as at least a portion of the asphalt material passes through the grate; and (c) discharging the asphalt material out the smaller lower open end of the hopper insert onto a conveyor of the asphalt paving machine;

wherein step (a) further comprises retaining at least a portion of the asphalt material on the grate between at least two opposed lateral retainer walls on opposite sides of the grate, the retainer walls being laterally spaced from a peripheral wall of the hopper insert; and further comprising:

filling the hopper insert to a larger one of two optional fill levels by depositing the asphalt material between the two retainer walls and allowing the asphalt material to overflow the retainer walls so that the deposited asphalt material is also received within a lateral volume between each of the retainer walls and the peripheral wall of the hopper insert.

6. A method of passive mixing of asphalt material with a hopper insert for an asphalt paving machine, the hopper insert including a larger upper open end and a smaller lower open end so that the hopper insert is funnel shaped, the method comprising:

receiving the asphalt material on top of a grate located nearer to the upper end than to the lower end of the hopper insert;

reducing an average clump size of the asphalt material as at least a portion of the asphalt material passes through the grate;

bypassing at least a bypass portion of the asphalt material around the grate as the asphalt material flows downward from the larger upper open end to the smaller lower open end; and discharging the asphalt material out the smaller lower open end of the hopper insert onto a conveyor of the asphalt paving machine.

* * * * *